US008162695B2

(12) United States Patent
Zhang et al.

(10) Patent No.: US 8,162,695 B2
(45) Date of Patent: Apr. 24, 2012

(54) ELECTRICAL CONNECTOR HAVING IMPROVED COMMON MODE CHOKE

(75) Inventors: Jie Zhang, Kunshan (CN); Chao-Tung Huang, Tu-Cheng (TW); Yong-Chun Xu, Kunshan (CN); Xiao-Hua Liu, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 434 days.

(21) Appl. No.: 12/384,228

(22) Filed: Apr. 2, 2009

(65) Prior Publication Data

US 2009/0253299 A1 Oct. 8, 2009

(30) Foreign Application Priority Data

Apr. 2, 2008 (CN) ..... 2008 2 0034927

(51) Int. Cl.
*H01R 13/66* (2006.01)

(52) U.S. Cl. ..... 439/620.22; 439/620.15

(58) Field of Classification Search ..... 430/620.21, 430/620.22, 620.24; 439/620.21, 620.22, 439/620.24, 620.23, 620.25, 620.15–620.19
See application file for complete search history.

(56) References Cited

U.S. PATENT DOCUMENTS

| | | | | |
|---|---|---|---|---|
| 6,918,790 | B2 | 7/2005 | Wan et al. | |
| 7,670,183 | B2 * | 3/2010 | Huang et al. | 439/620.05 |
| 7,708,594 | B2 * | 5/2010 | Xu | 439/620.05 |
| 7,708,595 | B2 * | 5/2010 | Chow et al. | 439/620.15 |
| 7,749,027 | B2 * | 7/2010 | Chow et al. | 439/620.15 |
| 7,841,902 | B2 * | 11/2010 | Chow et al. | 439/620.15 |
| 2008/0214052 | A1 * | 9/2008 | Li | 439/620.21 |

* cited by examiner

*Primary Examiner* — Felix O Figueroa
(74) *Attorney, Agent, or Firm* — Wei Te Chung; Andrew C. Cheng; Ming Chieh Chang

(57) ABSTRACT

An electrical connector (100) includes an insulative housing (10) and a terminal module (20) received in the insulative housing. The terminal module includes a daughter board (21), a choke group, a number of mating terminals (24) mounted on a first side of the daughter board, and a connecting module (22) mounted on a second side the daughter board and having a number of connecting terminals (221). The choke group has a number of transformer chokes (23) mounted to the second side of the daughter board, and a number of surface mount device chokes (25) adapted for being applied in automatic manufacture and mounted the second side of the daughter board.

7 Claims, 4 Drawing Sheets

ELECTRICAL CONNECTOR HAVING IMPROVED COMMON MODE CHOKE

BACKGROUND OF THE INVENTION

1. Field of the Invention

The present invention relates to an electrical connector, and more particularly to an electrical connector having improved common mode choke applied in high speed signal transmission system.

2. Description of Related Art

U.S. Pat. No. 6,918,790 issued on Jul. 19, 2005 discloses an electrical connector having an insulative housing, a terminal module and a shielding shell attached to the insulative housing. The terminal module comprises a daughter board, a plurality of mating terminals mounted on a front side of the daughter board, a plurality of mode chokes mounted on a back side of the daughter board and a connecting module assembled to the daughter board. The connecting module includes a base portion, a plurality of connecting terminals mounted on the base portion and electrically connected with the mode chokes via a plurality of circuit traces. The mode choke has an annular magnetic core and a plurality of magnetic wires manually wound around the magnetic core.

It is hard to achieve automatic SMT (Surface-mount technology), since the magnetic wires are needed to be manually wound around the magnetic core.

Hence, an electrical connector having improved common mode choke is highly desired.

SUMMARY OF THE INVENTION

Accordingly, an object of the present invention is to provide an electrical connector capable of achieving automatic manufacture.

In order to achieve the object set forth, an electrical connector in accordance with the present invention an insulative housing and a terminal module received in the insulative housing. The terminal module includes a daughter board, a choke group, a number of mating terminals mounted on a first side of the daughter board, and a connecting module mounted on a second side opposite to the first side of the daughter board and having a number of connecting terminals. The choke group has a number of transformer chokes mounted to the second side of the daughter board and electrically connected with the mating terminals, and a number of surface mount device chokes mounted the second side of the daughter board and electrically connected with the connecting terminals.

The surface mount device chokes could be soldered to the daughter board directly without any manually wound wires. Compared to the traditional common mode choke having wires manually wound around the core portion, the surface mount device chokes are adapted for being applied in automatic manufacture.

Other objects, advantages and novel features of the invention will become more apparent from the following detailed description when taken in conjunction with the accompanying drawings.

DETAILED DESCRIPTION OF THE PREFERRED EMBODIMENT

Figure 1:
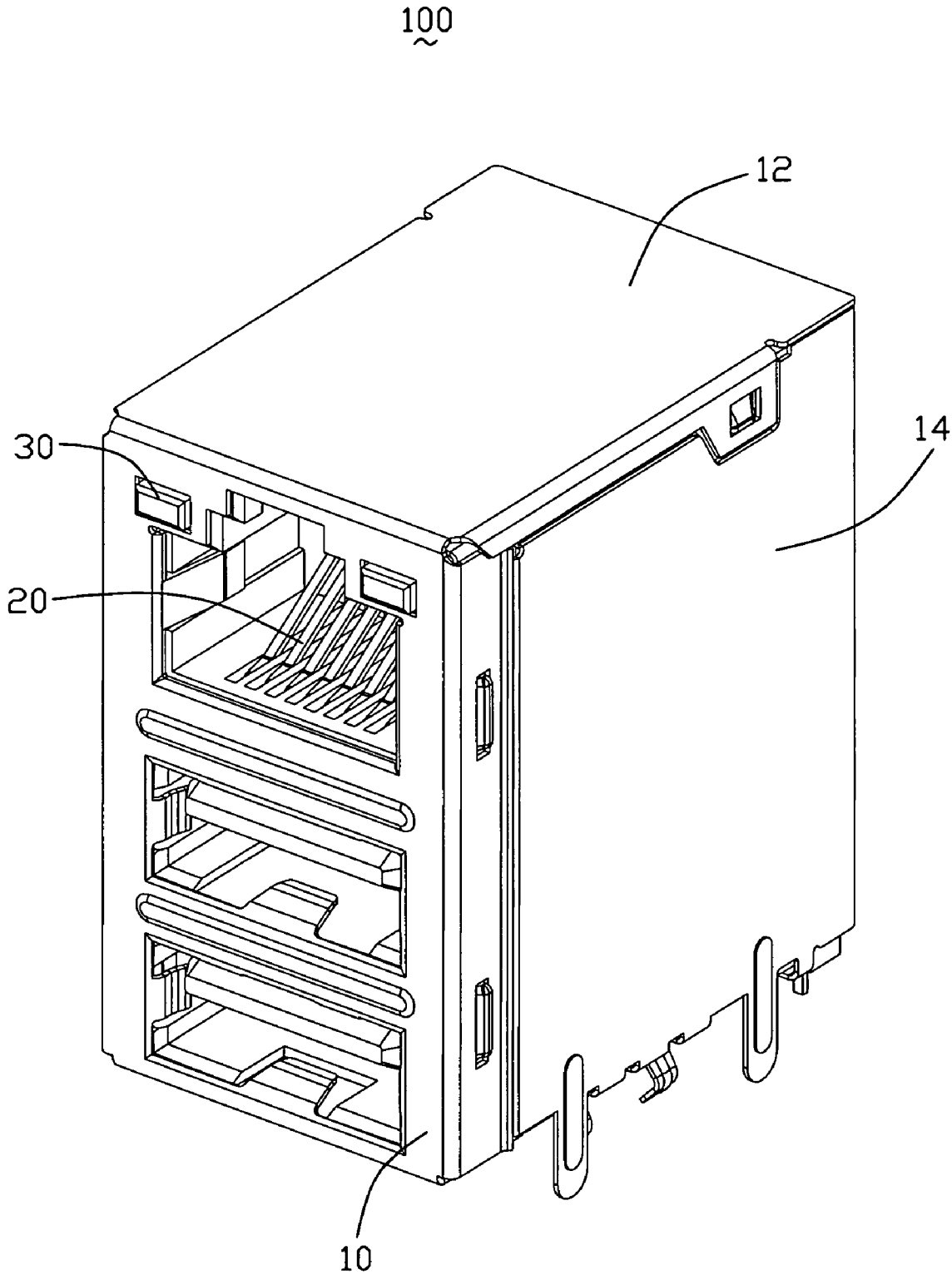
FIG. 1 is an assembled perspective view showing an electrical connector in accordance with the present invention.
Figure 2:
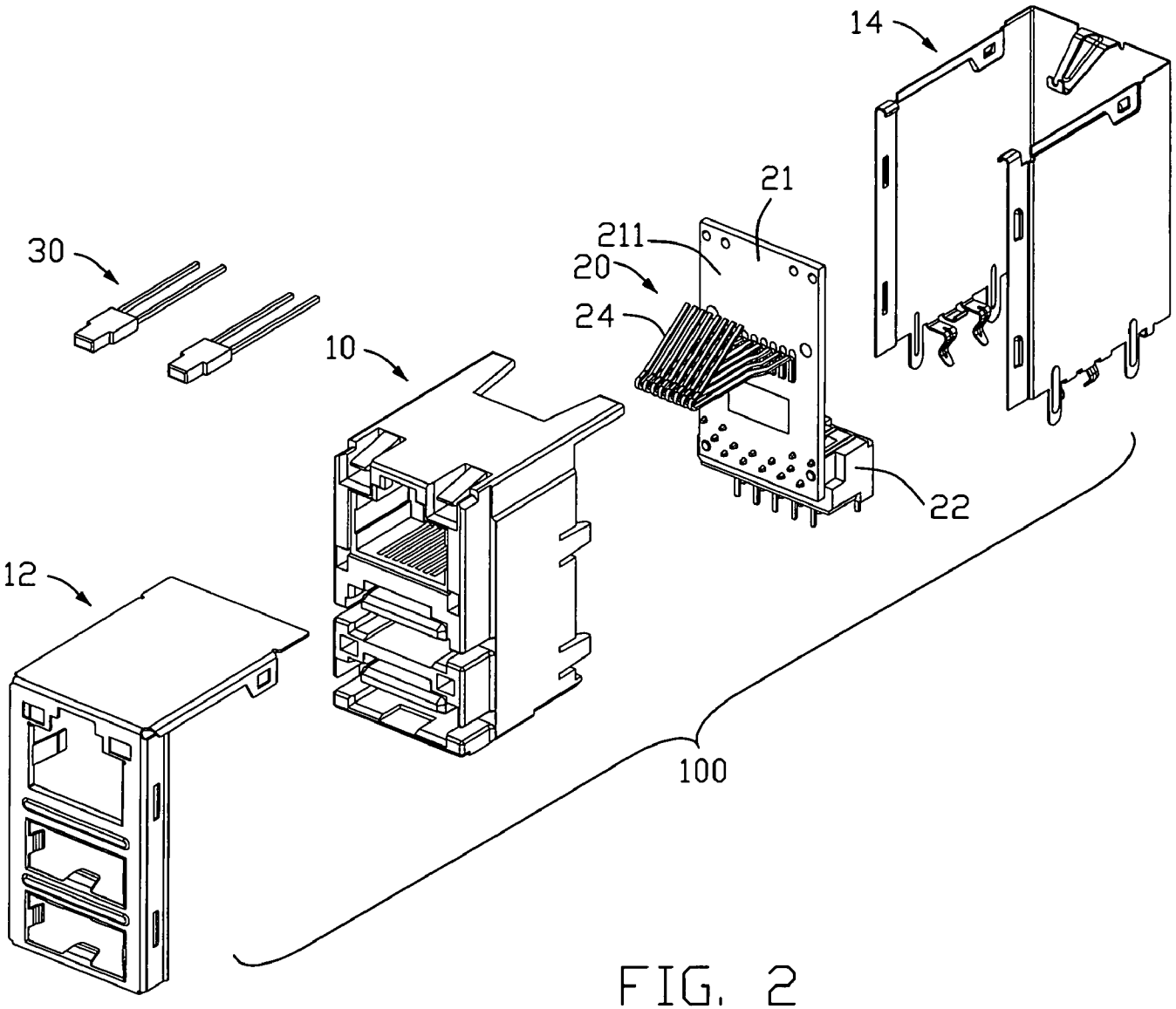
FIG. 2 is an exploded perspective view showing the electrical connector.

Reference will now be made in detail to the preferred embodiment of the present invention. Referring to FIGS. 1 and 2, an electrical connector 100 mounted to a mother board (not shown) comprises an insulative housing 10, a terminal module 20 retained in the insulative housing 10, a pair of LEDs (light-emitting diodes) 30 inserted in the insulative housing 10, a first and a second shielding shells 12 and 14 attached to the insulative housing 10.

Figure 3:
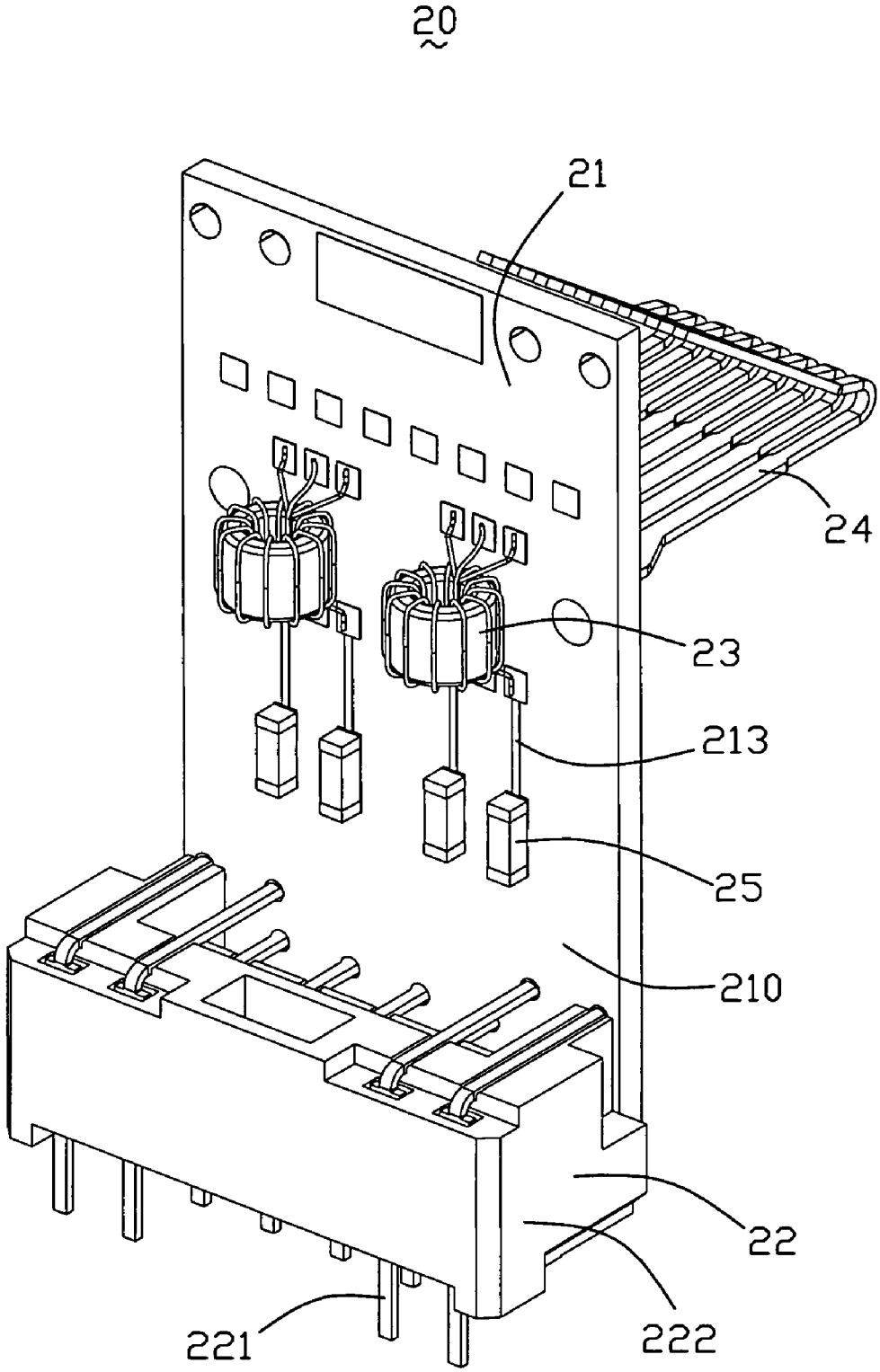
FIG. 3 is an assembled perspective view showing a terminal module.
Figure 4:
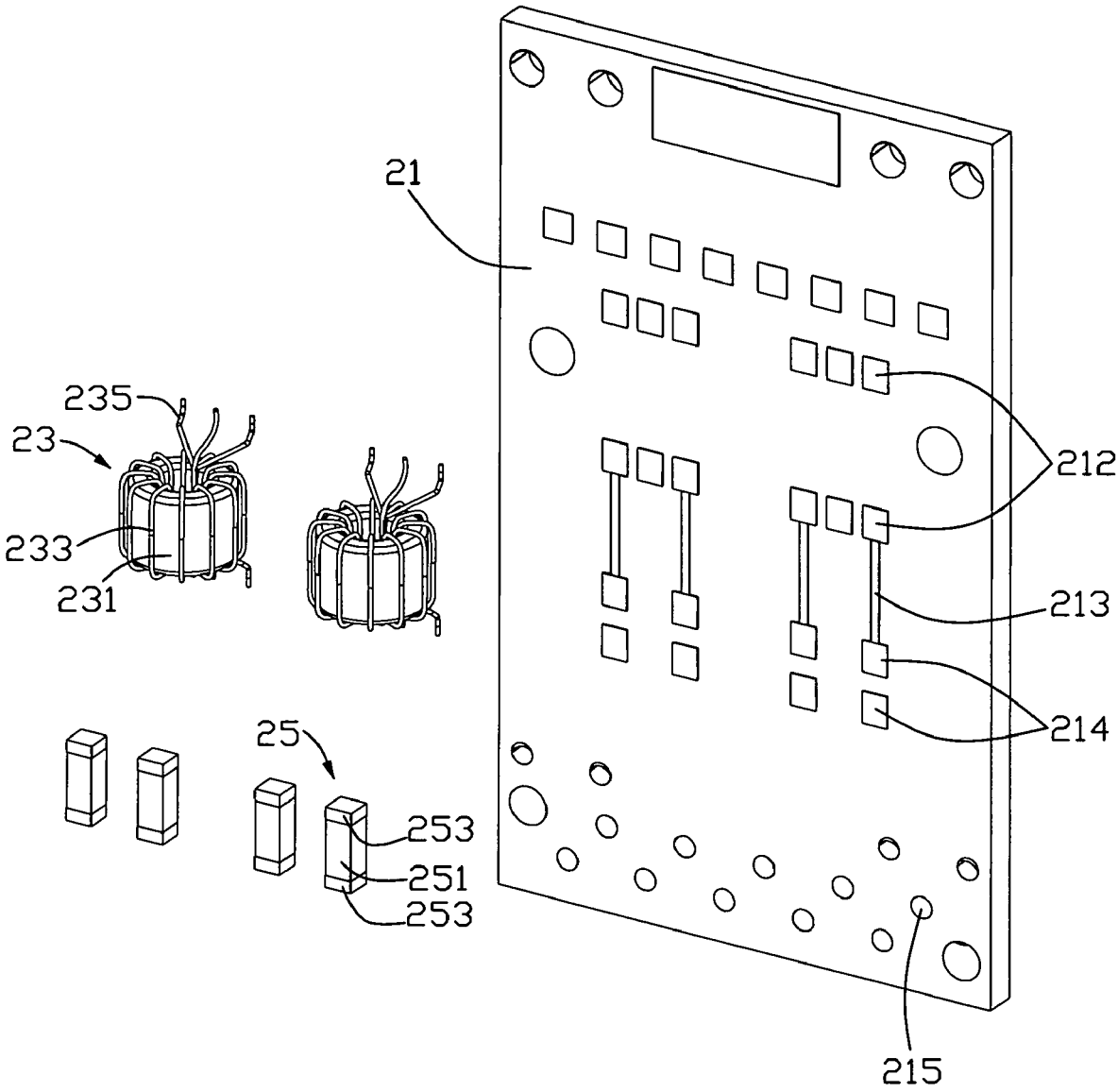
FIG. 4 is an exploded perspective view showing the terminal module as shown in FIG. 3.

Referring to FIGS. 2-4, the terminal module 20 comprises a daughter board 21 having a front side 211 and an opposite back side 210, a plurality of mating terminals 24 mounted on the front side 211 of the daughter board 21, a choke group mounted on the back side 210 of the daughter board 21 and a connecting module 22 assembled to the back side 210 of the daughter board 21. The daughter board 21 has a plurality of through holes 215 defined therethrough. The front and back sides 211, 210 are served as input and output sides.

The daughter board 21 has a first and second rows of first conductive pads 212, and a first and second rows of second conductive pads 214, and a plurality of circuit traces 213 electrically connected with the second row of first conductive pads 212 and the first row of second conductive pads 214 mounted at the back side 210. The choke group comprise two transformer chokes 23 and four common mode chokes 25, with each transformer choke 23 according to two common mode chokes 25. Each transformer choke 23 comprises an annular magnetic core 231 and a plurality of magnetic wires 233 wound around the magnetic core 231. The magnetic wire 233 has opposite upper and lower tips 235. Each common mode choke 25 is formed into an SMD (Surface Mount Device) choke 25, and comprises a rectangular core portion 251, upper and lower soldering portions 253 formed at opposite ends of the core portion 251.

The connecting module 22 comprises a base portion 222 and a plurality of L-shaped connecting terminals 221 mounted on the base portion 222.

Referring to FIGS. 1-4, in assembly of the electrical connector 100, the mating terminals 24 are assembled to the front side 211 of the daughter board 21 firstly. The transformer chokes 23 are assembled to the back side 210 of the daughter board 21, with upper and lower tips 235 of the magnetic wires 233 respectively soldered onto the first and second rows of upper conductive pads 212. The SMD chokes 25 are mounted on the back side 21 of the daughter board 21, with the upper and lower soldering portions 253 respectively soldered to the first and second rows of lower conductive pads 214 by SMT (Surface Mount Technology). The SMD chokes 25 are electrically connected with the transformer chokes 23 via the circuit traces 213.

Next, the connecting module 22 is assembled to a lower portion of the back side 210 of the daughter board 21, with upper ends of the connecting terminals 221 inserted through the through holes 215, and lower ends of the connecting terminals 221 connected to the mother board. The terminal module 20 is assembled as a whole.

The soldering portions 253 of the SMD chokes 25 could be soldered to the second conductive pads 214 directly without any manually wound wires. Compared to the traditional common mode choke having wires manually wound around the core portion, the SMD chokes 25 are adapted for being applied in automatic manufacture.

Finally, the LEDs 30 are inserted into the insulative housing 10. The first and second shielding shells 12 and 14 are attached to a front side and a back side of the insulative housing 10 and engaged with each other. The electrical connector 100 is assembled into a whole.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing; and a terminal module received in the insulative housing, said terminal module comprising a daughter board, a choke group, a plurality of mating terminals mounted on a first side of the daughter board, and a connecting module mounted on a second side opposite to the first side of the daughter board and having a plurality of connecting terminals, said choke group having a plurality of transformer chokes mounted to the second side of the daughter board and electrically connected with the mating terminals, and a plurality of surface mount device chokes mounted on the second side of the daughter board and electrically connected with the connecting terminals, each transformer choke electrically connected to two surface mount device chokes at a same side.

2. The electrical connector as claimed in claim 1, wherein said surface mount device choke has a core portion and a pair of soldering portions formed at opposite ends of the core portion, the daughter board having first and second rows of conductive pads, said pair of soldering portions respectively soldered onto and electrically connected with the first and second rows of conductive pads by surface mount technology.

3. The electrical connector as claimed in claim 2, wherein said daughter board has third and fourth rows of conductive pads mounted on the second side, and wherein each transformer choke comprises a magnetic core and a plurality of magnetic wires wound around the magnetic core, said magnetic wires having upper and lower ends respectively connected with said third and fourth rows of conductive pads.

4. The electrical connector as claimed in claim 3, wherein said daughter board comprises a plurality of circuit traces electrically connected with the fourth row of conductive pads and the first row of conductive pads.

5. The electrical connector as claimed in claim 1, wherein said daughter board has a plurality of through holes defined therethrough for insertion of the connecting terminals.

6. The electrical connector as claimed in claim 1, wherein said first side of the daughter board is served as an input side, and said second side of the daughter board is served as an output side.

7. The electrical connector as claimed in claim 1, further comprising first and second shielding shells attached to the insulative housing and engaged with each other.

* * * * *